US008701524B2

(12) United States Patent
Chang et al.

(10) Patent No.: US 8,701,524 B2
(45) Date of Patent: Apr. 22, 2014

(54) COMPLEX WRENCH

(76) Inventors: Chiou-Mai Chang, Taichung (TW); Yueh-Li Wang, Taichung (TW)

( * ) Notice: Subject to any disclaimer, the term of this patent is extended or adjusted under 35 U.S.C. 154(b) by 252 days.

(21) Appl. No.: 13/275,305

(22) Filed: Oct. 17, 2011

(65) Prior Publication Data

US 2013/0091993 A1 Apr. 18, 2013

(51) Int. Cl.

| | |
|---|---|
| ***B25B 13/46*** | (2006.01) |
| ***B25B 13/02*** | (2006.01) |
| ***B25B 23/16*** | (2006.01) |
| ***B25B 13/04*** | (2006.01) |
| ***B25B 13/08*** | (2006.01) |
| ***G09F 7/16*** | (2006.01) |

(52) U.S. Cl.

CPC ..... *B25B 13/02* (2013.01); *B25B 13/04* (2013.01); *B25B 13/08* (2013.01); *B25B 13/46* (2013.01); *B25B 23/16* (2013.01); *G09F 7/165* (2013.01)

USPC ..... 81/60; 81/125.1; 81/177.1

(58) Field of Classification Search

USPC ..... 81/119, 177.1, 60, 125.1

See application file for complete search history.

(56) References Cited

U.S. PATENT DOCUMENTS

| | | | | |
|---|---|---|---|---|
| 1,793,714 | A * | 2/1931 | Newberg | 81/125.1 |
| 6,655,239 | B1 * | 12/2003 | Macor | 81/125.1 |
| 6,792,833 | B2 * | 9/2004 | Macor | 81/125.1 |
| 6,959,628 | B2 * | 11/2005 | Macor | 81/125.1 |
| 7,047,845 | B2 * | 5/2006 | Macor | 81/177.1 |
| 7,387,052 | B2 * | 6/2008 | Chang et al. | 81/177.1 |
| 7,631,582 | B2 * | 12/2009 | Hu | 81/177.1 |
| 2004/0035261 | A1 * | 2/2004 | Macor | 81/125.1 |
| 2009/0032484 | A1 * | 2/2009 | Hu | 211/70.6 |
| 2011/0192260 | A1 * | 8/2011 | Hsieh | 81/177.1 |
| 2012/0017729 | A1 * | 1/2012 | Chang | 81/60 |

* cited by examiner

*Primary Examiner* — David B Thomas

(57) ABSTRACT

The present invention discloses a complex wrench composed of a strip-shaped shank which includes a front section, a middle section and a rear section along its length direction in order thereof, the front section and the rear section connecting a first driving head and a second driving head respectively, the middle section being a twisted section which makes the axis lines of the first driving head and the second driving head on different planes, and the middle section having at least one sunken area where is covered with a plurality of embossed patterns.

5 Claims, 8 Drawing Sheets

COMPLEX WRENCH

FIELD OF THE INVENTION

The present invention relates to a wrench, and more particularly to a complex wrench whose shank has a twisted section and sunken area with knurls to enhance the holding stability and manipulation convenience.

BACKGROUND OF THE INVENTION

A conventional complex wrench is shown as U.S. Pat. No. 1,793,714, which includes one strip-shaped shank. The shank has a smooth metal surface. The middle section of the shank has one twisted section. Each of the two ends of the twisted section horizontally extends to connect an open-shaped driving head. The patented complex wrench has a twisted section to enhance the holding convenience, but its shank has a smooth metal surface which is easy to slip off user's hand. Besides, its shank doesn't have an embossed mark to indicate the size of the main body. When the user wants to select a tool of required size from many main bodies, it is very easy for the user to take a tool of incorrect size because the main body doesn't have an embossed mark.

SUMMARY OF THE INVENTION

The chief object of this new model is to provide a complex wrench whose shank has a twisted section and sunken area with knurls to enhance holding stability and manipulation convenience. The strip-shaped shank comprises one front section, one middle section and one rear section along its length direction in order. The ends of the front section and the rear section connect a first driving head and a second driving head respectively. The middle section is a twisted section which makes the axis lines of the first driving head and the second driving head on different planes, wherein the shank has at least one sunken area where is covered with a plurality of knurls.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
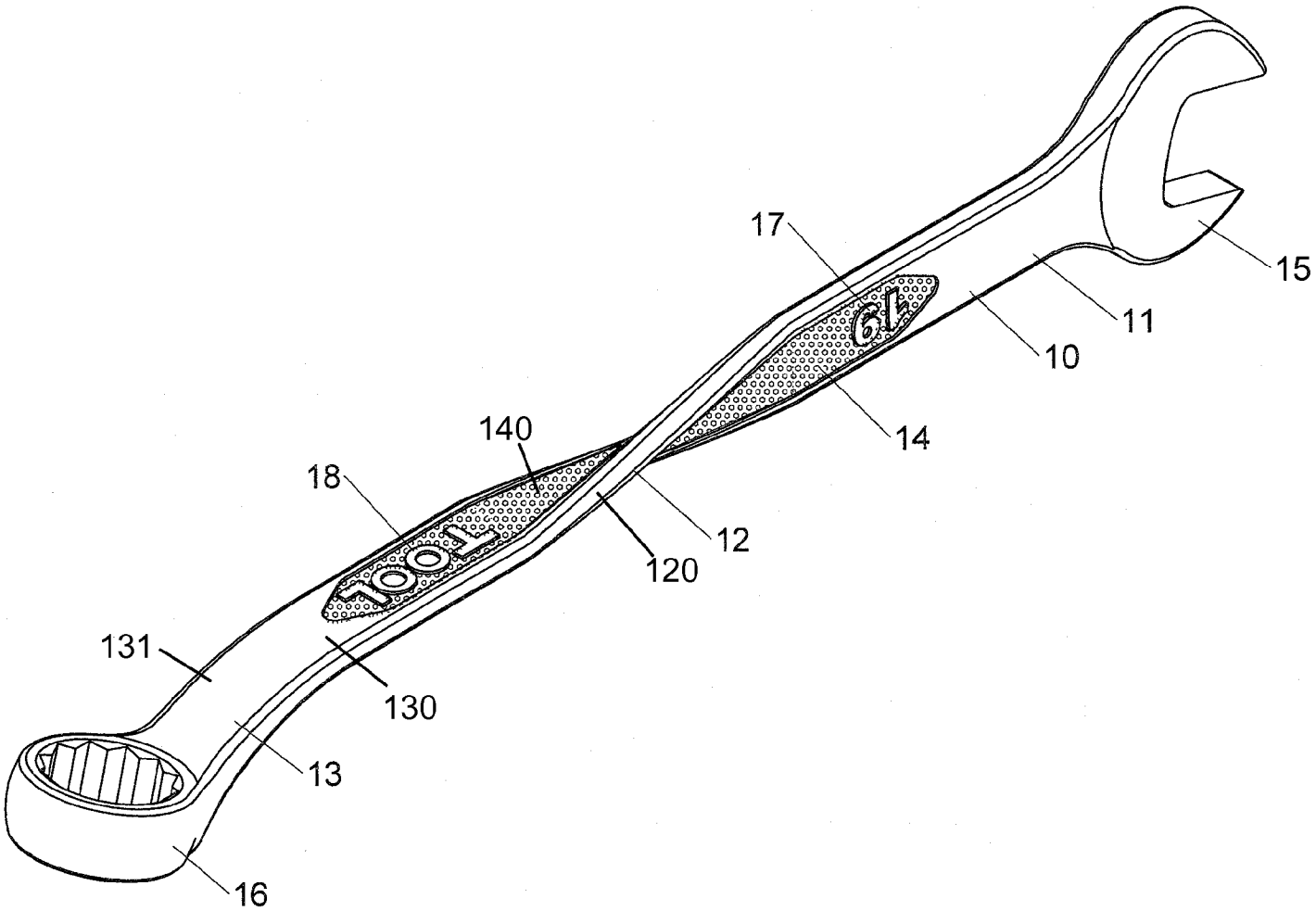
FIG. 1 is a 3-D drawing of the complex wrench of the present invention.
Figure 2:
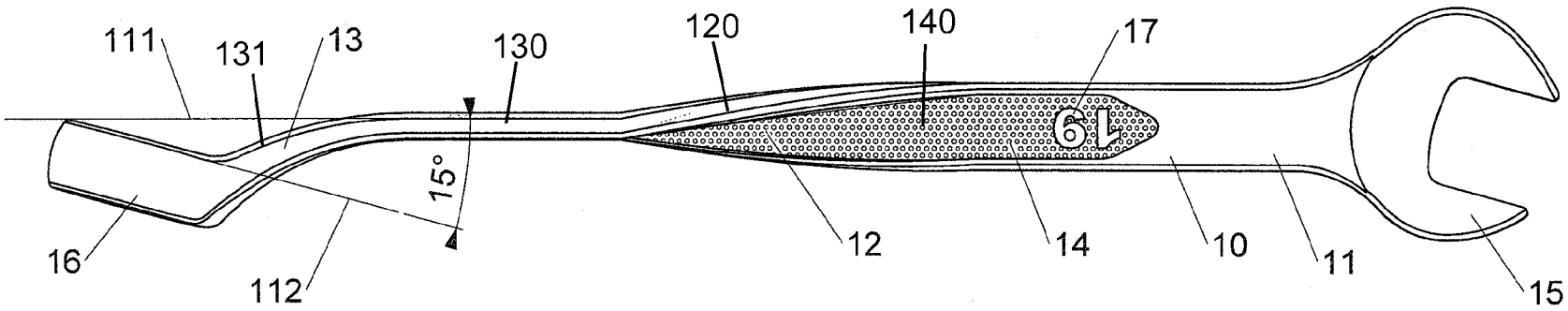
FIG. 2 is a lateral view of the complex wrench of the present invention.

Referring to FIGS. 1 to 5, the open wrench of the present invention comprises a body 10, a movable member 20, a clip 30 and a spring 40. FIGS. 1 and 2 show a complex wrench of the present invention which includes a strip-shaped shank 10 comprising a front section 11, a middle section 12 and a rear section 13 along the shank length direction in order. The ends of the front section 11 and the rear section 13 connect a first driving head 15 and a second driving head 16 respectively. The middle section 12 is a twisted section 120 which makes the axes of the first driving head 15 and the second driving head 16 on different planes. (The figures show that the two axes are perpendicular to each other, wherein the surface of the shank 10 has at least one sunken area 14 wherein intensive plurality of knurls 140 is implemented therein. The plurality of knurls 140 are made of a plurality of hemispheroid granules or cone granules.

Referring to the figures, the sunken area 14 is arranged on the surface of the twisted section 120, and the two ends of the sunken area 14 extend to the surfaces of the front section 11 and the rear section 13. Furthermore, in order to enhance holding stability, the raised ends of the knurls 140 protrude from the opening of the sunken area 14.

Figure 3:
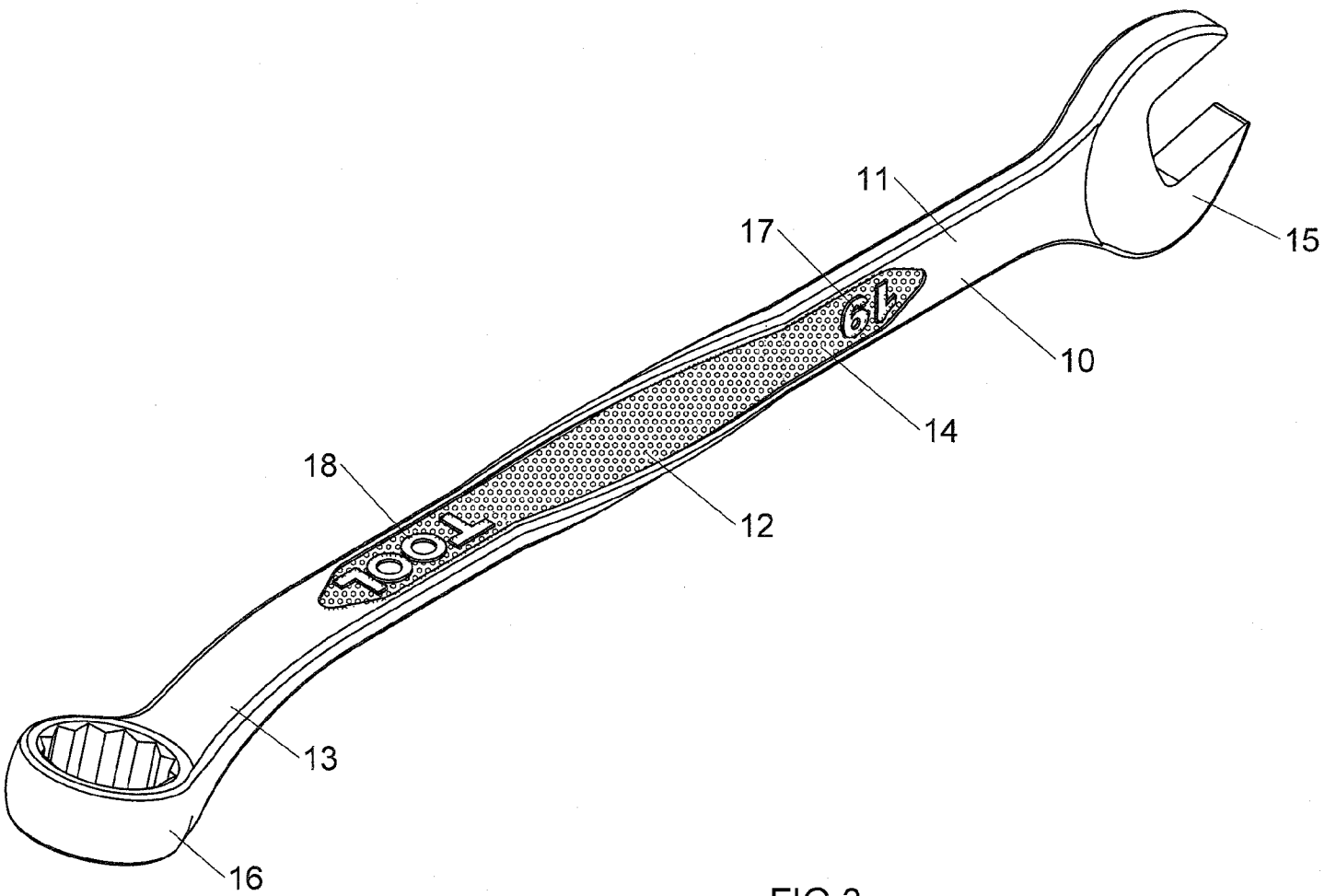
FIG. 3 is a 3-D drawing of one embodiment showing the twisted section of the present invention twisted in another direction.
Figure 4:
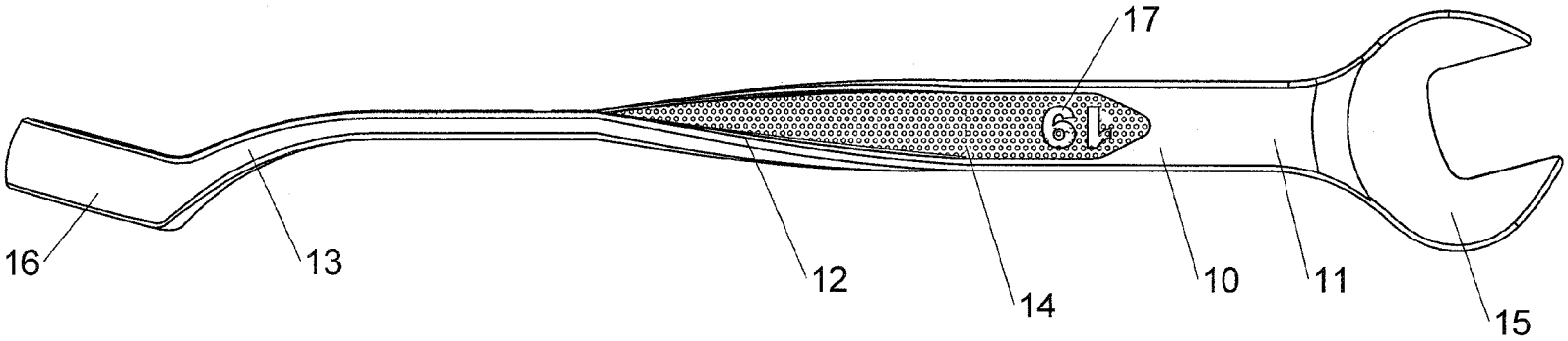
FIG. 4 is a lateral view of one embodiment showing the twisted section of the present invention twisted in other direction.

FIGS. 3 and 4 are the schematic drawings showing the twisted section 120 twisted in another direction. The sunken area 14 near the first driving head 15 is provided with a first embossed mark 17 therein which shows the size of the wrench. The sunken area 14 near the second driving head 16 is provided with a second embossed mark 18 therein which is the brand name or a symbol.

Referring to FIGS. 1 and 2, the present new model is in a preferred embodiment. The rear section 13 of the shank 10 includes a horizontal section 130 and an arc section 131 at the rear section 13.

Figure 6:
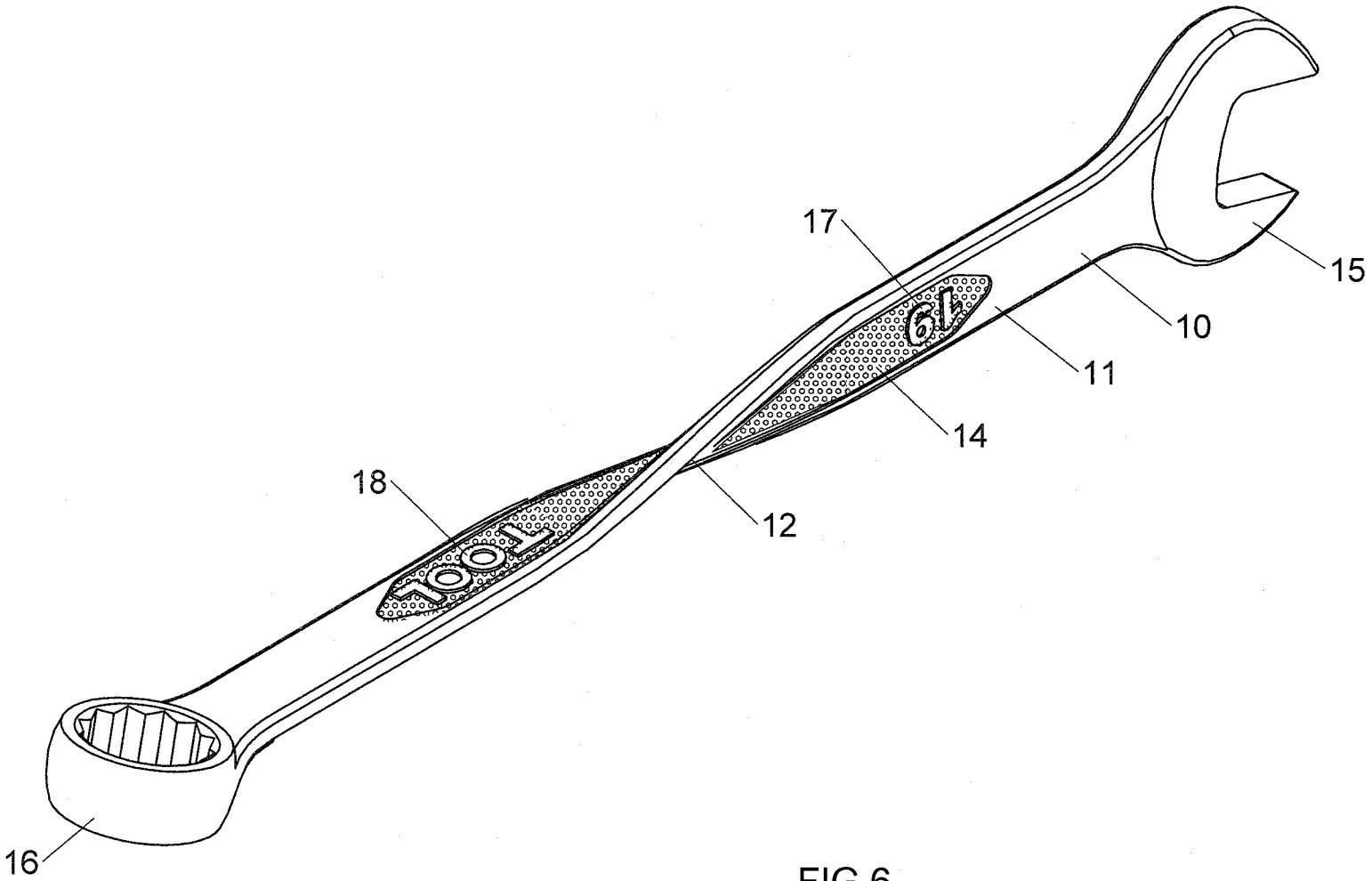
FIG. 6 is a 3-D drawing of one embodiment showing the front section and the rear section of the shank of the present invention to be horizontal sections respectively.
Figure 7:
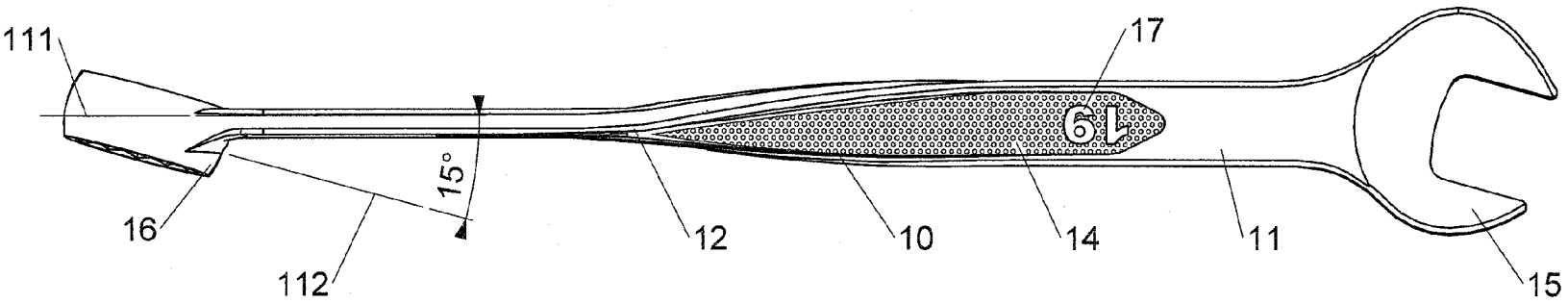
FIG. 7 is a lateral view of one embodiment showing the front section and the rear section of the shank of the present invention to be horizontal sections respectively.

A perpendicular plane 112 of the axis line of the second driving head 16 and a tangent plane 111 of the horizontal section 130 form an included angle between 15 degrees and 90 degrees (in FIG. 2 shows the included angle as 15 degree). Referring to FIGS. 6 and 7, the front section 11 and the rear section 13 of the shank 10 are all of a horizontal section 130. Referring to FIGS. 3 and 4, the twisted direction of the twisted section 120 is in reverse to the directions of the embodiments of FIGS. 1 and 2.

FIGS. 1 and 2 show an embodiment of the present new model. The first driving head 15 of the open end wrench is in an opening form. The second driving head 16 of the box end wrench is in a close ring form.

Figure 5:
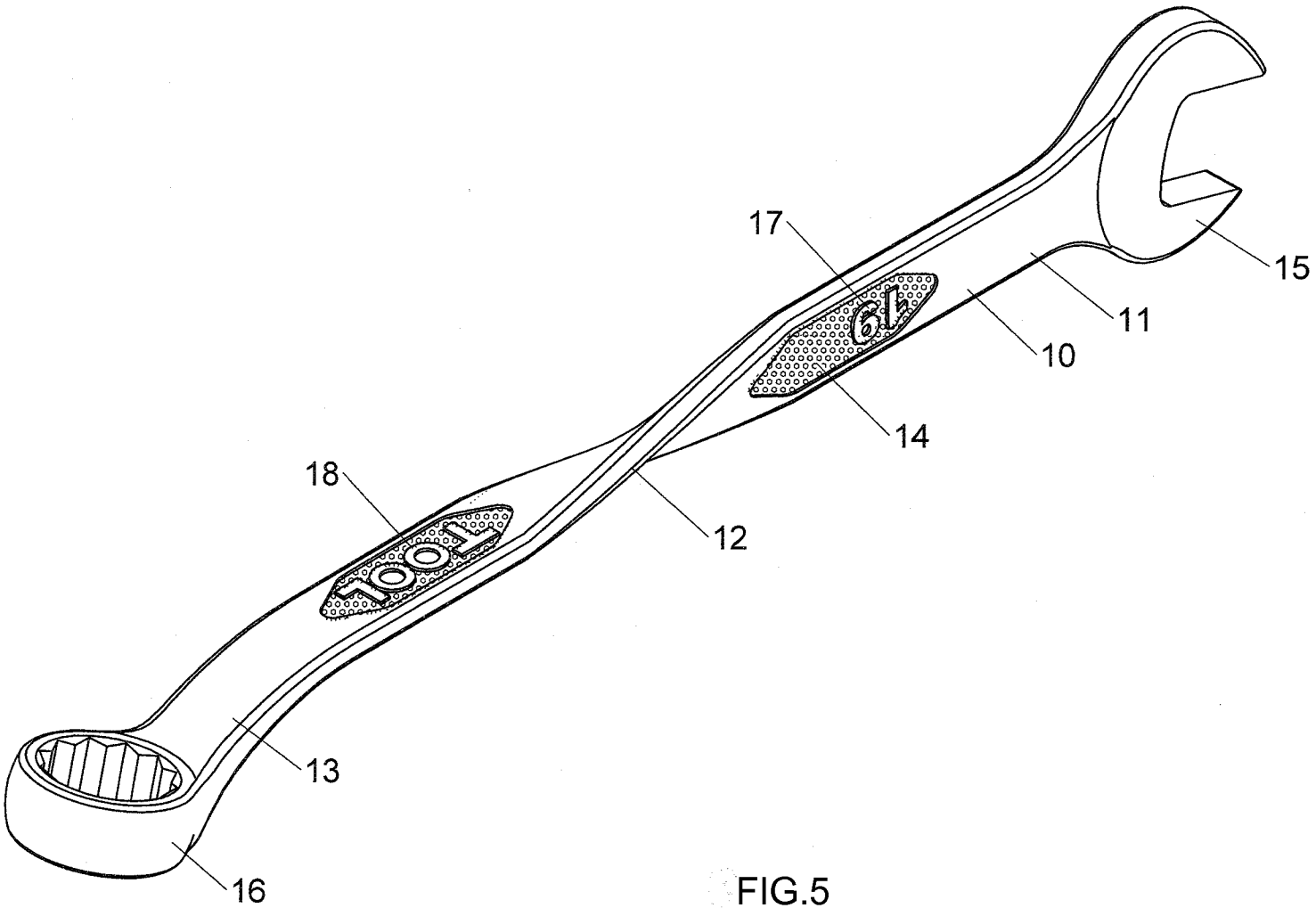
FIG. 5 is a drawing of one embodiment showing the present invention with two sunken areas.

FIG. 5 shows another embodiment of the new model. The shank 10 has at least two sunken areas 14. The two sunken areas 14 are arranged on the surfaces of the first section 11 and the rear section 13 respectively.

Figure 8:
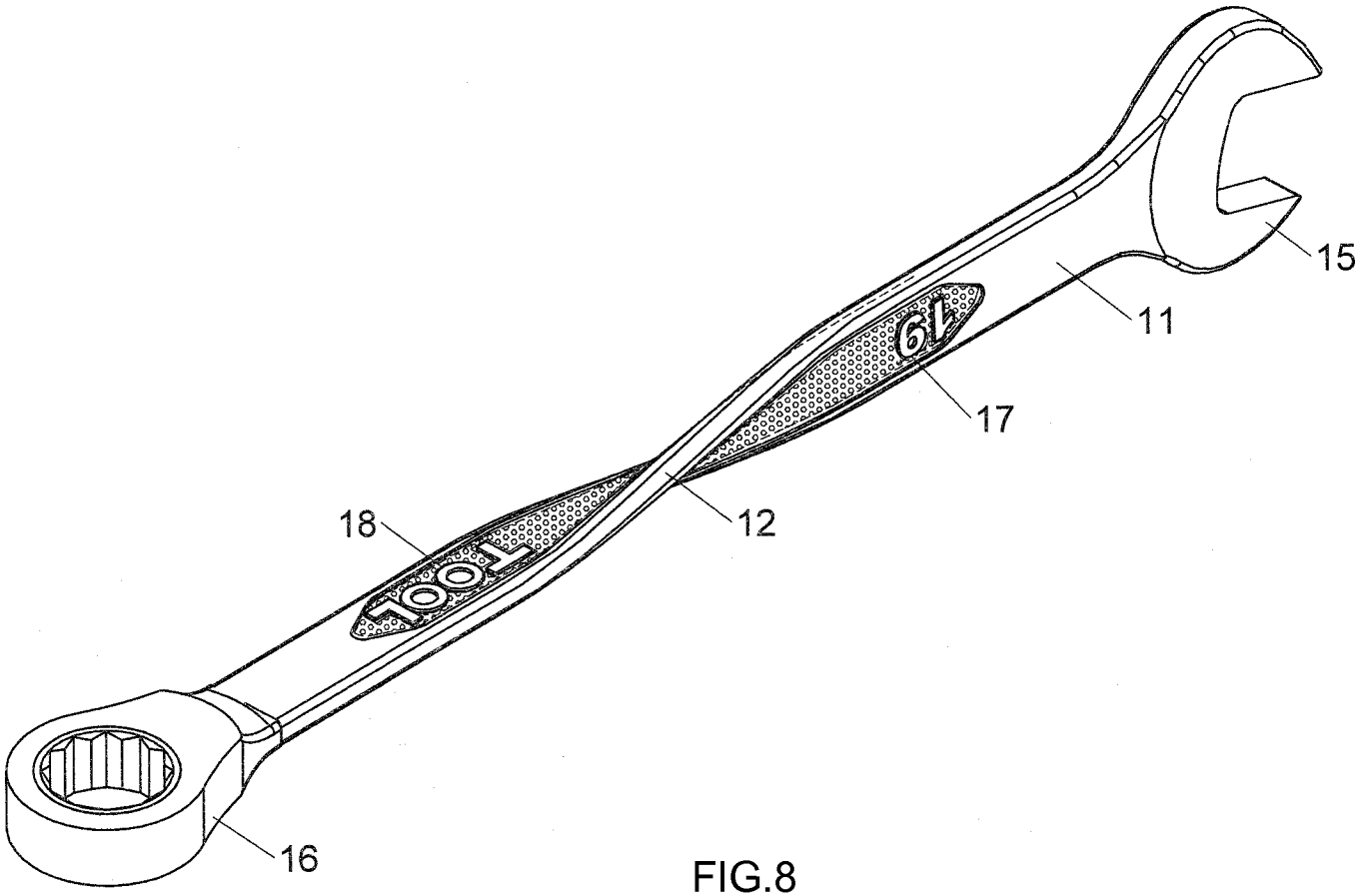
FIG. 8 is a 3-D drawing of one embodiment showing a ratchet mechanism in the interior of the second driving head 16 of the present invention.

FIG. 8 shows other embodiment of the new model. The interior of the second driving head 16 has a ratchet mechanism (not shown in the drawing). The ratchet mechanism can make one way or two way driving.

The merits of the complex wrench of this new model are: (1) the shank 10 has a twisted section 120. The surface of the shank has embossed patterns 140, it is very convenient for the user to firmly hold the shank, and manipulate the wrench; and (2) the two ends of the sunken area 14 have embossed marks, and it greatly enhances the identification function of the wrench and tactile sense.

While we have shown and described the embodiment in accordance with the present invention, it should be clear to those skilled in the art that further embodiments may be made without departing from the scope of the present invention.

What is claimed is:

1. A complex wrench comprising:

a strip-shaped shank having a front section, a middle section and a rear section; the ends of the front section and the rear section connecting a first driving head and a second driving head respectively; the middle section being a twisted section which makes the axes of the first driving head and the second driving head on different planes, the rear section including a horizontal section and an arc section within the rear section, a perpendicular plane of the axis of the second driving head and a tangent plane of the horizontal section forming an included angle, the included angle being between 15 degrees and 90 degrees, the surface of the shank being provided with at least one sunken area wherein intensive plurality of knurls is implemented therein, the sunken area being on the surface of the twisted section, and the two ends of the sunken area extending to the surfaces of the front section and the rear section.

2. The complex wrench as claimed in claim 1, wherein the heights of the knurls are higher than the depth of the sunken area so that the raised ends of the knurls protrude from the opening of the sunken area.

3. The complex wrench as claimed in claim 1, wherein the first driving head is in an opening form while the second driving head is in form of close ring.

4. The complex wrench as claimed in claim 1, wherein the interior of the second driving head is provided with a ratchet mechanism.

5. The complex wrench as claimed in claim 1, wherein the sunken area near the first driving head is provided with a first embossed mark therein showing the size of the wrench while the sunken area near the second driving head is provided with a second embossed mark therein being a brand name or a symbol.

* * * * *